US006440312B1

(12) United States Patent
Kasevich

(10) Patent No.: US 6,440,312 B1
(45) Date of Patent: Aug. 27, 2002

(54) EXTRACTING OIL AND WATER FROM DRILL CUTTINGS USING RF ENERGY

(75) Inventor: Raymond S. Kasevich, Mt. Washington, MA (US)

(73) Assignee: Kai Technologies, Inc., Great Barrington, MA (US)

( * ) Notice: Subject to any disclaimer, the term of this patent is extended or adjusted under 35 U.S.C. 154(b) by 0 days.

(21) Appl. No.: 09/563,460

(22) Filed: May 2, 2000

(51) Int. Cl.[7] ..... C02F 1/30; B01D 17/02; B01D 1/00; E21B 21/01

(52) U.S. Cl. ..... 210/748; 210/774; 210/178; 210/179; 210/180; 175/207; 250/492.1

(58) Field of Search ..... 210/748, 774, 210/175, 179, 180, 198.1, 209–211, 218, 219; 34/255, 259; 175/206, 207; 134/1, 105; 250/253, 254, 492.1; 202/108, 113, 117, 118, 133–135

(56) References Cited

U.S. PATENT DOCUMENTS

| | | | | |
|---|---|---|---|---|
| 3,951,904 | A | * | 4/1976 | Tomonaga |
| 4,304,609 | A | * | 12/1981 | Morris |
| 4,387,514 | A | * | 6/1983 | McCaskill, Jr. |
| 4,401,162 | A | * | 8/1983 | Osborne |
| 4,438,367 | A | * | 3/1984 | Kerns et al. |
| 4,453,319 | A | * | 6/1984 | Morris |
| 4,508,168 | A | * | 4/1985 | Heeren |
| 4,608,859 | A | | 9/1986 | Rockley |
| 4,620,593 | A | * | 11/1986 | Haagensen |
| 4,670,634 | A | * | 6/1987 | Bridges et al. |
| 4,735,733 | A | * | 4/1988 | Blumenthal et al. |
| 4,817,711 | A | * | 4/1989 | Jeambey |
| 4,853,507 | A | * | 8/1989 | Samardzija |
| 4,855,695 | A | * | 8/1989 | Samardzija |
| 4,912,971 | A | * | 4/1990 | Jeambey |
| 5,055,180 | A | * | 10/1991 | Klaila |
| 5,152,341 | A | | 10/1992 | Kasevich |
| 5,236,039 | A | * | 8/1993 | Edelstein et al. |
| 5,567,324 | A | * | 10/1996 | Rothmel et al. |
| 5,723,844 | A | * | 3/1998 | Dow et al. |
| 6,086,830 | A | * | 7/2000 | Kartchner |
| 6,097,985 | A | * | 8/2000 | Kasevich et al. |

FOREIGN PATENT DOCUMENTS

| | | |
|---|---|---|
| JP | 5-5286018 | * 11/1993 |
| WO | WO 84/03021 | 8/1984 |
| WO | WO 00/49269 | 8/2000 |

* cited by examiner

*Primary Examiner*—David A. Simmons
*Assistant Examiner*—Fred Prince
(74) *Attorney, Agent, or Firm*—Fish & Richardson P.C.

(57) ABSTRACT

A system and method for separating oil from an oil tailing having water includes introducing the oil tailing within a chamber, and applying RF energy to the oil tailing at a temperature sufficient to convert the water to steam and to separate the oil from the tailing. The system allows removal of the water from the tailing followed by RF energy absorption by the tailing prior to substantial heat transfer to the surrounding mineral portion of the tailing. Among other advantages, the system produces tailings substantially devoid of oil, thereby allowing the tailing to be disposed of in an environmentally safe manner. The system is particularly advantageous for offshore drilling operations where storage and subsequent hauling of the oil tailings ashore for processing and disposal is expensive.

46 Claims, 4 Drawing Sheets

EXTRACTING OIL AND WATER FROM DRILL CUTTINGS USING RF ENERGY

BACKGROUND

The invention relates to extracting oil from tailings or cuttings, for example, of the type removed from the earth during an oil drilling operation.

The waste or refuse product pulled from the earth during an oil drilling process is generally known as an "oil tailing" or "oil cutting." An oil tailing typically consists of a wet, muddy, and relatively dense, sludge-like mixture of sand, dirt, oil and water. Such oil tailings can be distinguished from oil emulsions, which consist a suspension of liquid within a liquid, here of a mixture of oil and water.

In a typical oil drilling operation, hundreds of tons of oil tailings are produced. In the production of oil from subsurface bodies, the drilling requirements require safe, environmentally responsible and cost-effective oil bore mud cuttings or tailings dispersal methods. The maximum amount of oil allowed by regulatory agencies to be discharged into the ocean for off shore drilling platforms is typically about 10 Kg per 1000 Kg of tailings. Furthermore, hauling tailings ashore can be very difficult, risky and expensive. Although on-site disposal eliminates the transport risks and reduces platform storage requirements, on-site disposal requires that the tailings be disposed of at the same rate that they are generated.

The tailings processing requirements depends on the rate at which the tailings are generated from a typical well. 17.5 inch (444-mm) diameter and smaller holes are typically used to drill through oil-based mud; thus, processing requirements are usually based on a 17.5 inch hole. The volume of tailings generated in a 17.5-inch hole in 77 hours of drilling time is 1705 barrels. It is difficult to store a significant portion of this volume for later processing. As a result, the entire tailings stream must be processed as it is generated. A minimum tailings processing rate would be 14.3 tons/hour for a penetration rate of 30.5 meters per hour. Ultimately, the selected tailings cleaning rate determines the maximum sustained penetration rate which is allowed.

Due to the limited amount of storage possible on an offshore drilling platform, if the tailings processing equipment fails, drilling must stop. Moreover, because space is often limited on an oil platform and drilling rig, tailings processing equipment is preferably designed to use a minimum of space. The equipment should also be skid mounted and reasonably portable.

SUMMARY

The invention features a system and method for separating oil from oil tailings including water.

In a first aspect of the invention, the system includes a chamber for receiving the oil tailings and an RF heating system having radiating structure for applying RF energy to heat the oil tailings to a temperature sufficient to convert the water to steam and to separate the oil from the tailings.

In another aspect of the invention, a method of separating oil from oil tailings including water, the method includes applying RF energy to the oil tailings at a temperature sufficient to convert the water to steam and to separate the oil from the tailing.

Embodiments of these aspects of the invention may include one or more of the following features.

The radiating structure is configured to have a first system voltage standing wave ratio (VSWR) characteristic (e.g., less than 2.5:1) during a first heating stage and a second VSWR characteristic during a second heating stage (e.g., greater than 2.5:1), the first VSWR characteristic being lower than the second VSWR characteristic. In a preferred embodiment, the first heating stage precedes the second heating stage. Thus, the radiating structure is configured (e.g., by tuning) to have a better impedance match during the first heating stage than the second heating stage. The lower first VSWR characteristic is used during the first heating stage when it is more desirable to have efficient energy transfer into the tailing, while the second VSWR characteristic is used where the tailing has reached a sufficient temperature that a less than optimum VSWR is acceptable for further heating of the oil.

The first heating stage is defined by the oil tailing having a temperature in a range between 95° and 105° C. and the second heating stage is defined by the oil tailing having a temperature greater than 105° C. The system includes a third heating stage, preceding the second heating stage, which is defined by the oil tailing having a temperature less than 100° C.

In certain embodiments, the system includes an air blower configured to provide air flow through the chamber, and a heat exchange system for heating the air flow provided by the air blower. Airflow is provided to the oil tailings to move heated air within the chamber, thereby providing more uniform heating of the oil tailing. The airflow is continuously provided through the chamber to keep the heat of the oil tailings below the latent heat of vaporization of water.

The radiating structure includes a slotted transmission line and, in some embodiments, includes tuning structure for adjusting the impedance of the slotted transmission line. In an alternative embodiment, the radiating structure is a capacitive structure. The radiating capacitive structure is formed by electrically isolated portions of the chamber (formed of electrically conductive walls). For example, the chamber can be formed by a pair of opposing arcuate members which together form a cylindrically shaped chamber. Alternatively, the radiating capacitive structure can include a first element formed by an integral electrically conductive outer cylindrical wall of the chamber. The second element of the radiating structure is provided by a coaxially disposed conductor, which can be an auger screw for moving the cuttings through the chamber. The system further includes a conveyor for moving (e.g., using an auger) the oil tailing from a first end of the chamber to a second end of the chamber.

In certain embodiments, the system and method further includes second radiating structure for applying RF energy to heat the oil tailing to a temperature sufficient to convert the water to steam and to separate the oil from the tailing. The second radiating structure has a third VSWR characteristic during the first heating stage and a fourth VSWR characteristic during the second heating stage. The first and fourth VSWR characteristics are smaller than the second and third VSWR characteristics.

In certain embodiments, the system and method further includes a reservoir including a fluid for increasing the viscosity of the tailings prior to introduction to the chamber; and a pump for introducing the fluid to the tailings. The fluid can include a RF absorptive material, such as carbon.

The system and method removes water from the tailings to allow the oil remaining in the tailings to be more selectively absorptive. Among other advantages, the system and method produces tailings that are substantially devoid of oil, thereby allowing the tailing to be disposed in an environmentally safe manner. The system and method are particularly advantageous for offshore drilling operations where storage and subsequent hauling of the oil tailings ashore for processing and disposal is expensive. By providing the system and method described above at an offshore site, the tailings can be processed as they are generated and then discharged back into the ocean with only the extracted oil stored for further processing. Thus, providing the system and method at an offshore operation eliminates transport risks, reduces storage requirements, and provides an environmentally safe approach for disposing of the tailings. Furthermore, the oil extracted from the tailing significantly supplements the oil recovered from the normal drilling operation. The system and method accomplishes these advantages through selective energy absorption, while operating the systems at low energy levels, thereby realizing a significant energy saving.

Other features and advantages will be readily apparent from the following description, the accompanying drawings and the claims.

DETAILED DESCRIPTION

Figure 1:
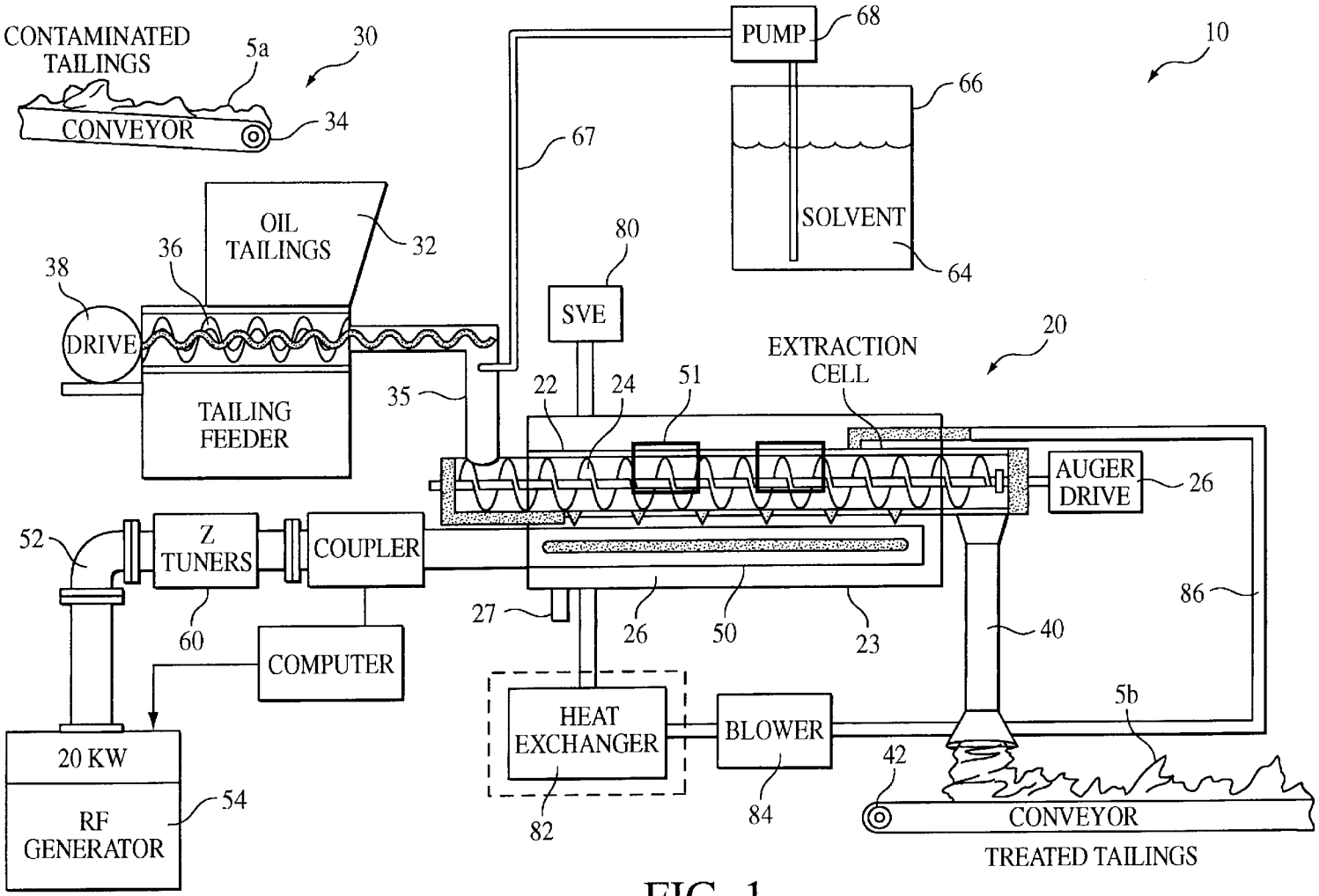
FIG. 1 is a diagrammatic representation of an oil tailing treatment system of the invention.

Referring to FIG. 1, an oil tailing treatment system 10 includes a radio frequency (RF) heating unit 20 which receives untreated oil tailings 5*a* from a feeder system 30 and delivers treated tailings 5*b* to a collection system (not shown). Feeder system 30 includes a disposal bin 32 which receives untreated oil tailings 5*a* from a conveyor 34 and feeds the tailings to an inlet pipe 35 using an auger screw 36 rotated by a drive assembly 38. Inlet pipe 35, in turn, conveys untreated tailings 5*a* to the first end of a cylindrical chamber 22 of RF heating unit 20. Oil tailing treatment system 10 is configured to process approximately 1–10 tons of untreated tailings in an hour. A typical untreated tailing consists of approximately 20–30% mineral content, sand, sediment; 20–30% water; and 40–60% oil, which is desired to be extracted. Such untreated tailings 5*a* has a wet, muddy, relatively dense, "sludge-like" consistency.

Cylindrical chamber 22 is positioned within a housing 23 and includes a second auger screw 24, rotatably driven by an associated drive assembly 26. Auger screw 24 extends along the longitudinal axis of cylindrical chamber 22 to move the tailings to an opposite end of cylindrical chamber 22 where they are deposited through an outlet pipe 40 to a conveyor 42. The speed at which drive assembly 26 moves auger screw 24 depends primarily on the size of the oil tailing being moved through cylindrical chamber 22. For example, for a one-ton oil tailing, drive assembly 26 operates to move an oil tailing through chamber 22 in approximately one hour. Cylindrical chamber 22 includes a drip pan 25 where oil from the tailing is collected and removed, via an outlet 27. Conveyor 42 collects treated tailings 5*b* where they are delivered to the collection system for storage or to be transported to a landfill or dumpsite.

RF heating unit 20 includes a coaxial slotted transmission line 50 extending substantially the entire length of cylindrical chamber 22. Slotted transmission line 50 is electrically connected, via a coaxial transmission line 52, to a RF generator 54 capable of delivering between 10 Kwatt and 50 Kwatts (preferably about 20 Kwatts) in a frequency range between about 1 MHz and 5,000 MHz. In certain embodiments, RF generator 54 is operated in pulse mode, for example, with a 50% duty cycle, to reduce the cost of the overall system.

Oil tailing treatment system 10 also includes a soil vapor extraction (SVE) system 80 having a heat exchanger 82 which provides a controlled flow of heated air through cylindrical chamber 22. SVE system 80 also includes an air blower 84 connected to chamber 22 to provide a controlled flow of air from one end of the chamber to the opposite end of the chamber. An outlet pipe 86 extends from the end of chamber 22 to a return port of the heat exchanger 82. Thus, the pipe provides a return path for the air and evaporated moisture. The SVE system works to minimize the RF energy required by the heating system to remove the liquids from the oil tailings. By controlling the amount of airflow through the tailing the hot vapors and liquids (water oil emulsions for later treatment) can be extracted from the chamber. The hot vapors are condensed and the resulting emulsions are further processed along with the extracted liquid emulsion. Thus, RF heating unit 20 and SVE system 80 provide heating of the tailings in the form of a combination of both electromagnetic and mechanical heating. The heat of condensation will then be advantageously reintroduced into chamber 22, thereby reducing the amount of RF power required for heating.

Figure 2:
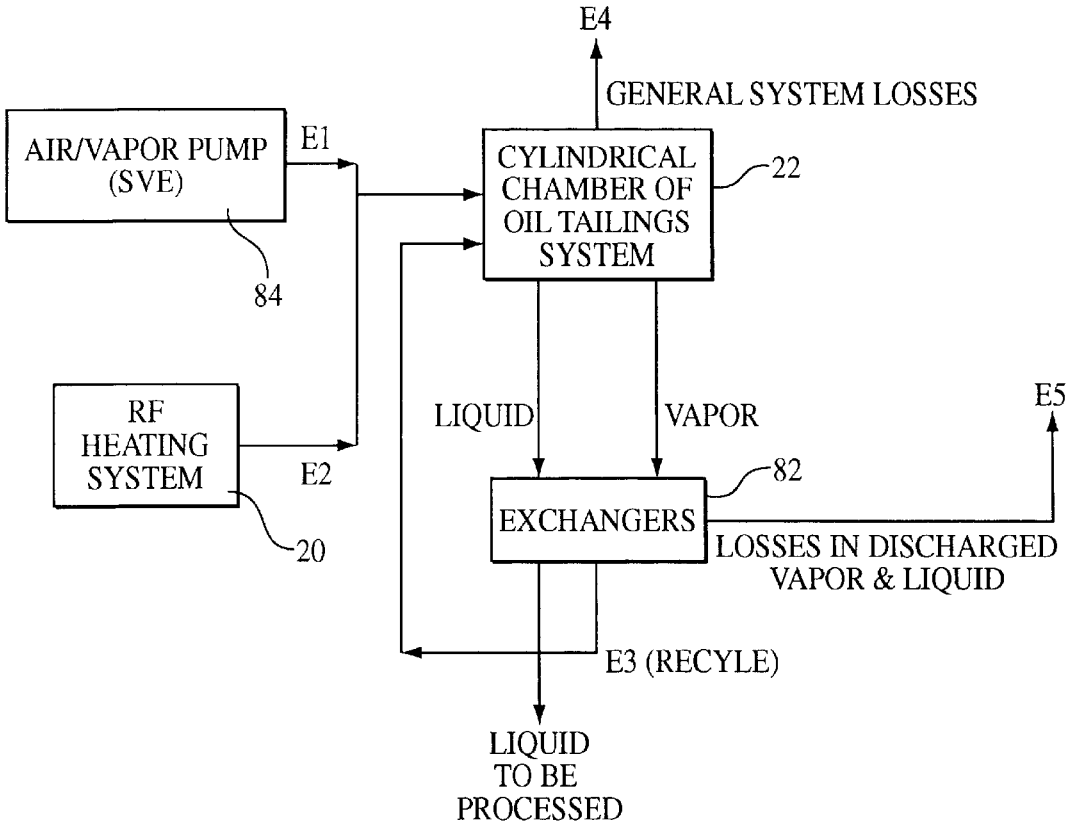
FIG. 2 is a block diagram representation of the oil tailing system of FIG. 1 showing the energy flow through the system.

Referring to FIG. 2, an energy flow diagram illustrates the flow of energy into and out of the system. Energy is introduced to the oil tailings from RF heating system 20, convective air blower 84, and heat exchanger 82 (E2, E1; and E3, respectively). General system energy E4 and energy associated with the discharged vapor and liquid E5, on the other hand, are losses associated with the system. As the RF heating pattern is established through the oil tailings to desorb the water from the oil tailings, the simultaneous application of the air flow carries heat and water vapor to the outside of the chamber 22 where the hot liquids are condensed and processed. The hot air derived from heat exchanger 82 is reintroduced into the oil tailings volume within chamber 22 to enhance the overall process energy efficiency.

At radio frequencies, the basic mechanism for coupling high frequency electric fields into the water and oil molecules within the tailing is through dielectric polarization. By dielectric polarization it is meant that the radio frequency energy is coupling into electric dipoles (water and oil polar molecules) forcing a mechanical torque to exist on each molecule. The resultant rotation of the molecules produces heat, essentially by friction (i.e., interaction and rubbing together of the polar molecules). Ionic conductivity of materials within the tailings may also provide resistive heating, in addition to the dielectric heating.

As will be described in greater below, slotted transmission line 50 is designed to have a relatively well-matched impedance to the untreated oil tailings 5*b* during a period of heating in which liquid water present in untreated oil tailings 5*a* is being converted to steam. In general, this period of heating occurs when the oil tailings reach a temperature in a range between 95° and 105° C. and, in most cases, in a range between 100° and 102° C. This stage of heating is known as the "steam stripping" stage. Because the dielectric properties of the oil tailings are, to a large degree, a function of the water and oil content, the impedance and VSWR characteristic presented to slotted transmission line 50 by the oil tailings passing through RF heating unit 20 varies significantly. In one embodiment, slotted transmission line 50 is tuned to have an optimum VSWR characteristic when the oil tailings are heated to their steam stripping stage. Tuning of slotted transmission line 50 is accomplished, for example, using tuners (e.g., sliding shorts or tuning slugs) whose positions can be determined theoretically or empirically. An instrumentation port 51 is positioned along the length of cylindrical chamber 22 to monitor the level of power and temperature within the cylindrical chamber 22. For example, sensors in the form of high temperature power thermistors and fiber optic probes can be used to measure and temperature, respectively. A controller receives the sensed power levels and temperature and then adjusts the tuning, either electrically or mechanically, to optimize the VSWR characteristic. By measuring the power transmission and/or impedance properties of the RF heating system 20, the amount of oil being removed can be determined so that upon completion of the process, less than one percent of the original oil content within the tailing remains. An RF diagnostic system that measures the complex impedance characteristics of the tailing during heating can be used to determine the level of oil contained within the tailing. One example of such a system is described in co-pending application Ser. No. 09/460,609 filed Dec. 14, 1999 and incorporated herein by reference.

Figure 3:
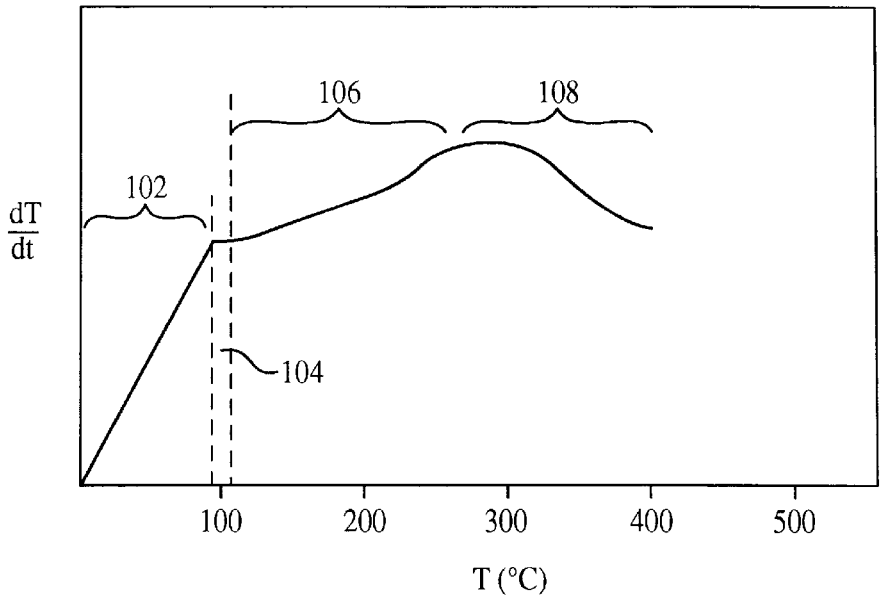
FIG. 3 is a graph showing the heating rate of a typical on-ton oil tailing as a function of temperature.

Referring to FIG. 3, the heating rate (dT/dt) of a typical one-ton oil tailing as a function of temperature T is shown. As is shown, during an initial temperature range 102 below approximately 98° C., the heating rate of the oil tailing rises rapidly due, in part, to the content of water in the tailing. Some oil vapor removal may begin to occur in this temperature range and beyond the range due to distillation mechanisms. Gravity-drained hot liquid oil will become mobilized as well. For a one ton tailing, this initial heating period may take between 10 and 25 minutes at a 20 kilowatt power level. In a narrower second temperature range 104 between about 98° C. and 102° C., the water becomes converted to steam. This so-called "steam stripping" stage may require between about 10 and 20 minutes for the "free" water to be fully driven from the tailing. In a third temperature range 106, between about 102° C. and 400° C., the temperature of the tailing continues to steadily rise at a slower rate at which the temperature of the oil in the tailing increases and selective heating begins. In this oil-heating stage, the oil becomes a combination of both vapor and liquid, which oozes from the tailing and drips to a lower portion of cylindrical chamber 22 where it is collected. Because the oil serves as the principal energy absorber in the third temperature range 106, once a substantial portion of the oil has been extracted from the tailing, the tailing becomes a relatively poor thermal heat conductor, the heating rate of the tailing decreases within a fourth temperature range 108.

Figure 4:
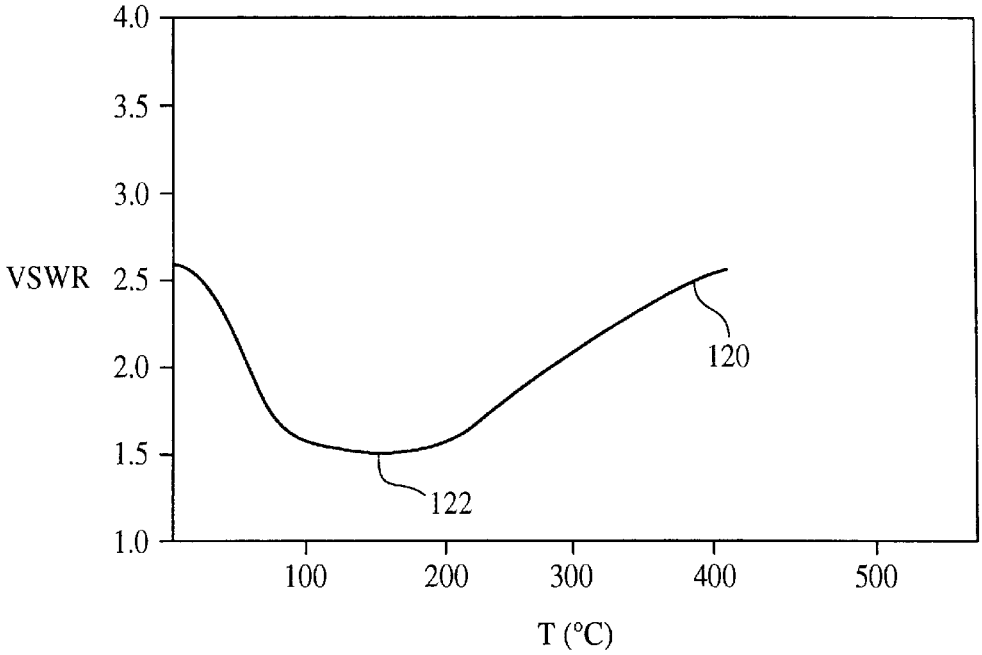
FIG. 4 is a graph showing the VSWR characteristic of the oil tailing treatment system of FIG. 1 as a function of temperature.

Referring to FIG. 4, a VSWR characteristic 120 for RF heating unit 20 radiating the typical one ton oil tailing is shown as a function of temperature T. In this particular embodiment, RF heating unit 20 is tuned to have a non-optimum impedance match and VSWR at ambient temperature. However, as the RF energy from heating unit 20 begins to heat the tailing, the VSWR characteristic (as well as the impedance match) improves so that a greater percentage of the incident RF energy is received by the tailing. In particular, for this embodiment of RF heating unit 20, VSWR characteristic 120 continues to improve until the oil tailing reaches the second temperature range 104 during which steam stripping occurs. In this temperature region, the water in the oil tailing is the principal energy absorber. As the water in the tailing is driven from the tailing, the dielectric properties of the tailing change significantly which, in turn, causes the impedance match and VSWR characteristic to change. As is shown in FIG. 4, once the tailing is virtually devoid of water (substantially at point 122) and its temperature continues to increase into temperature range 106, the VSWR becomes non-optimum again. Indeed, as the temperature of the tailing continues to increase, the VSWR characteristic becomes increasingly worse until a point at which the tailing has been stripped of oil. Optimizing the VSWR characteristic within second temperature range 104 is advantageous because the time required to remove the water is minimized, thereby allowing the start of selective oil heating process to begin. By selective heating it is meant that the oil absorbs energy from the RF heating unit at higher rates than the surrounding mineral content (e.g., sand, dirt) of the tailing. Once the tailings are substantially devoid of water, the radiation energy coupling to the oil substantially increases because the viscosity of the oil dramatically decreases. As the viscosity decreases, gravity is allowed to cause the oil to drain into regions of higher volumetric concentration where radiation coupling is further enhanced.

Referring again to FIG. 1, a tuning mechanism 60 is electrically connected between slotted transmission line 50 and RF generator 54 to allow the operator to adjust the impedance match between RF heating unit 20 and cylindrical chamber 22 through which tailings pass. Radiation penetration can be adjusted in the radial direction of cylindrical chamber 22 by adjusting the standing wave position of the electric field within the chamber by, for example, mechanical means.

In this embodiment, untreated tailings 5*a* are pre-treated with a solvent 64 to increase the tailing's ability to move through the cylindrical chamber 22. Solvent 64 is stored in a reservoir 66 and is pumped through conduit 67 with pump 68 to introduce the solvent to tailings passing through inlet pipe 35. In particular embodiments, solvent 64 can include RF absorptive material, such as powdered carbon or iron filings, to increase the amount of RF energy absorbed by the tailings.

Figure 5:
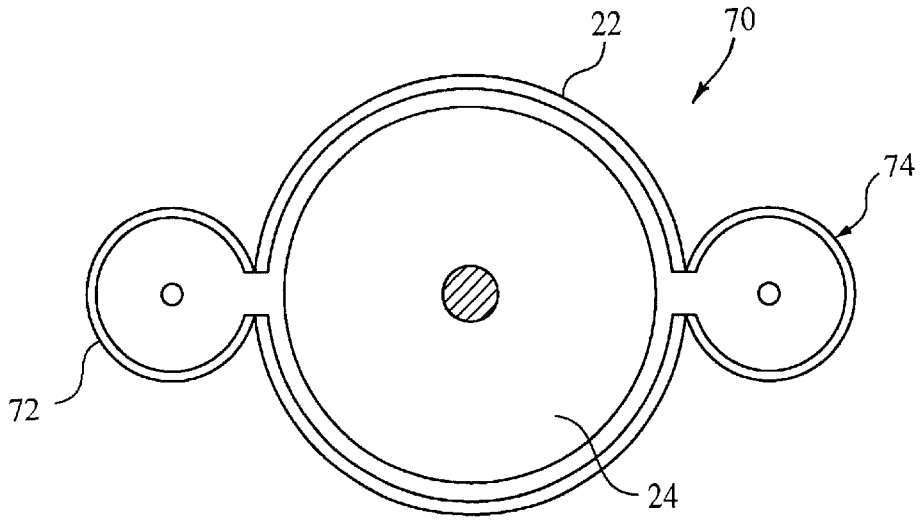
FIG. 5 is a diagrammatic representation of a cross-sectional end view of an alternative embodiment of an oil tailing treatment system.

Referring to FIG. 5, in an alternative embodiment, an RF heating system 70 includes a pair of slotted transmission lines 72, 74 attached at diametrically opposing positions of cylindrical chamber 22. In one approach for operating RF heating system 70, slotted transmission lines 72 and 74 are tuned to have optimum impedance matches in different stages of heating of the oil tailing. For example, slotted transmission line 72 is tuned to have an optimum impedance match within second temperature range 104, while slotted transmission line 74 has an optimum impedance match within one or both of first and third temperature ranges 102, 106, respectively. Thus, slotted transmission line 74 would be operated during the initial heating state (first temperature range) and the oil heating stage while slotted transmission line 72 is off. On the other hand, during the steam stripping stage, slotted transmission line 72 is turned on and slotted transmission line 74 is off.

Figure 6:
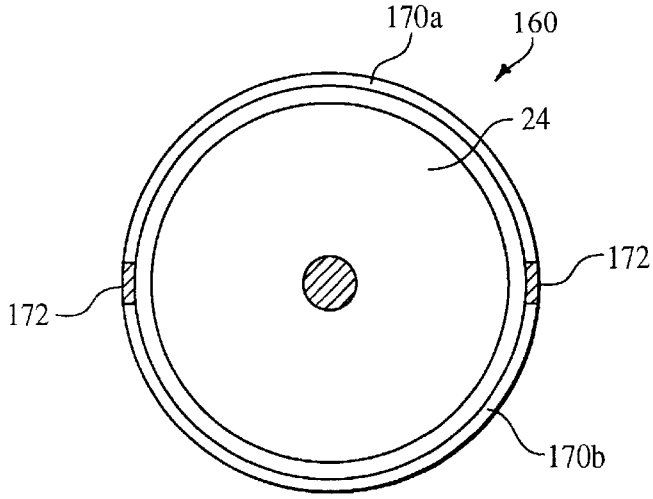
FIG. 6 is a diagrammatic representation of a cross-sectional view of another alternative embodiment of an oil tailing treatment system.

Referring to FIG. 6, in another alternative embodiment, an RF heating system 160 is in the form of a pair of diametrically opposed C-shaped cylindrical capacitive elements 170*a,* 170*b.* Electrodes 170*a,* 170*b* in cross section appear as a pair of semi-circular electrodes for providing a capacitive radiating structure.

In operation, voltage is applied to one electrode relative to the other, such that an electric field is generated for heating the oil cuttings as they pass between the electrodes. Insulative support members 172 are positioned at diametrically opposing positions to maintain a closed cylindrical structure while electrically isolating electrodes 170*a,* 170*b.*

In another embodiment, a capacitive radiating structure can be formed by biasing the outer cylindrical wall (formed of an electrically conductive material) relative to second auger screw 24 (also formed of an electrically conductive material). In this embodiment, insulative support members 172 are not required such that the outer cylindrical wall is formed of an integral cylinder biased at a common potential. It is appreciated that a positive voltage can be applied to the outer cylindrical wall relative to the auger or vice versa.

Figure 7:
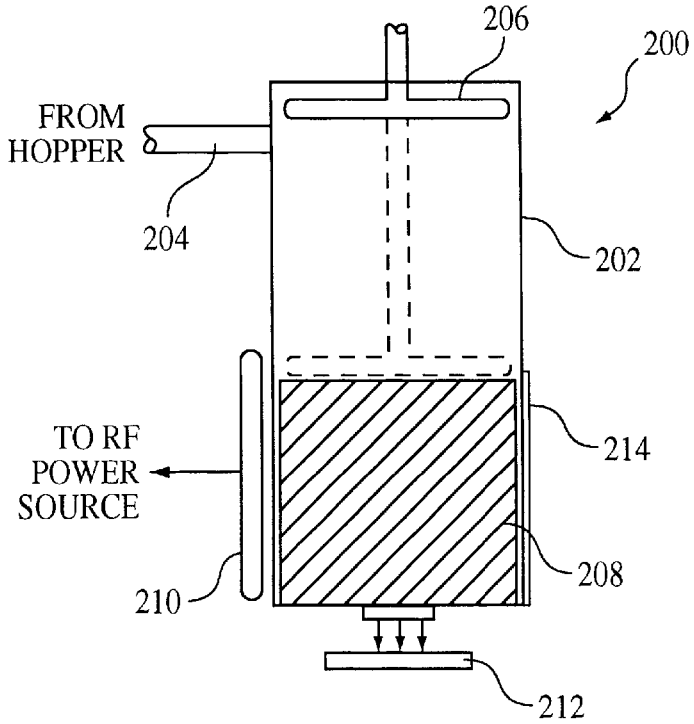
FIG. 7 is a diagrammatic representation of a cross-sectional view of still another alternative embodiment of an oil tailing treatment system.

Referring to FIG. 7, in still another alternative embodiment, an oil tailing treatment system 200 includes a vertically standing chamber 202 having an inlet pipe 204 through 15 which untreated oil tailings are fed. Unlike the embodiments described above, oil tailing treatment system 200 includes a piston-like plunger assembly 206 for compressing the untreated tailings at the lower end of the chamber into a compact homogeneous mass 208. Plunger assembly 206 is mechanically driven by an external drive assembly (not shown) from the top of chamber to a predetermined point at the lower end of the chamber (dashed lines). An RF heating system 210 (e.g., coaxial slotted transmission line) is positioned adjacent to and along the outer surface of the lower end of chamber 202 to apply RF energy to the compacted mass. During heating, oil drops to a drip pan 212 below the chamber. At the completion of the heating process, the treated tailing is removed from the chamber through a door 214. The process can be repeated with new untreated oil tailings.

Other embodiments are within the scope of the claims. For example, other radiating structures including collinear antenna array structures are also well-suited for use in RF heating systems 20. For example, the antenna arrays described in U.S. Pat. No. 5,152,341 and co-pending application Ser. No. 09/248,168, now U.S. Patent No. 6,097,985, both of which are incorporated by reference may be used to provide RF energy to the oil tailings.

What is claimed is:

1. A system for separating oil from an oil tailings including water, the system comprising:

a chamber including an electrically conductive wall, the chamber configured to receive the oil tailings; and an RF heating system including radiating structure for applying RF energy to heat the oil tailing to a temperature sufficient to convert the water to steam and to separate the oil from the tailing, the radiating structure having a conductive element in the form of an auger screw.

2. The system of claim 1 wherein the radiating structure is configured to have a first VSWR characteristic during a first heating stage and a second VSWR characteristic during a second heating stage, the first VSWR characteristic being smaller than the second VSWR characteristic.

3. The system of claim 2 further comprising a third heating stage preceding the second heating stage, the third heating stage defined by the oil tailing having a temperature less than 100° C.

4. The system of claim 2 further comprising second radiating structure for applying RF energy to heat the oil tailing to a temperature sufficient to convert the water to steam and to separate the oil from the tailing, the second radiating structure having a third VSWR characteristic during the first heating stage and a fourth VSWR characteristic during the second heating stage, the first and fourth VSWR characteristics being smaller than the second and third VSWR characteristics.

5. The system of claim 2 wherein the first heating stage precedes the second heating stage.

6. The system of claim 2 wherein the first VSWR characteristic is less than 2.5:1.

7. The system of claim 2 wherein the first heating stage is defined by the oil tailing having a temperature in a range between 95° and 105° C.

8. The system of claim 7, wherein the second heating stage is defined by the oil tailing having a temperature greater than 105° C.

9. The system of claim 1 wherein the radiating structure includes a slotted transmission line.

10. The system of claim 9 further comprising tuning structure for adjusting the impedance of the slotted transmission line.

11. The system of claim 1 wherein the radiating structure is formed by electrically isolated portions of the chamber.

12. The system of claim 1 wherein the auger screw is centrally positioned within the chamber.

13. The system of claim 12 wherein the chamber is cylindrically shaped and the auger screw is coaxially disposed within the cylindrically shaped chamber.

14. The system of claim 1 further comprising:

an air blower configured to provide air flow to the oil tailing within the chamber; and a heat exchange system for heating the air flow provided by the air blower.

15. The system of claim 1 further comprising a conveyor for moving the oil tailing from a first end of the chamber to a second end of the chamber.

16. The system of claim 15 wherein the conveyor includes the auger.

17. The system of claim 1 further comprising:

a reservoir including a fluid for increasing the viscosity of the tailings prior to introduction to the chamber; and a pump for introducing the fluid to the tailings.

18. The system of claim 17 wherein the fluid includes RF absorptive material.

19. The system of claim 18 wherein the RF absorptive material includes carbon.

20. The system of claim 1 wherein the radiating structure is configured to have a VSWR characteristic that is selected to cause selective heating of the oil after the water has been converted to steam.

21. A method of separating oil from oil tailings including water, the method comprising:

introducing the oil tailing to a chamber surrounding a conductor in the form of an auger screw;

applying RF energy to the oil tailing at a temperature sufficient to convert the water to steam and to separate the oil from the tailing; and continuously providing airflow through the chamber to maintain the temperature of the oil tailing below the temperature at which the water in the oil tailing would vaporize.

22. A method of separating oil from oil tailings including water, the method comprising:

introducing the oil tailing to a chamber surrounding a conductor in the form of an auger screw;

applying RF energy to the oil tailing at a temperature sufficient to convert the water to steam and to separate the oil from the tailing; and applying RF energy from a second radiating structure to the oil tailing at a temperature sufficient to convert the water to steam and to separate the oil from the tailing, the second radiating structure having a third VSWR characteristic during the first heating stage and a fourth VSWR characteristic during the second heating stage, the first and fourth VSWR characteristics being smaller than the second and third VSWR characteristics.

23. A system for separating oil from an oil tailings including water, the system comprising:

a chamber for receiving the oil tailings;

an RF heating system including radiating structure for applying RF energy to heat the oil tailing to a temperature sufficient to convert the water to steam and to separate the oil from the tailing; and wherein the radiating structure comprises at least two slotted transmission lines.

24. The system of claim 23 wherein a first one of the slotted transmission lines is positioned on a diametrically opposing side of the chamber from a second slotted transmission line.

25. The system of claim 24 wherein the first and second slotted transmission lines are configured to have a first heating stage and a second heating stage, respectively.

26. The system of claim 24 wherein first and second slotted transmission lines have an impedance, the impedance of the first transmission line being different from the impedance of the second transmission line.

27. The system of claim 26 wherein the radiating structure is configured to have a first heating stage and a second heating stage; and the impedance of the first transmission line is substantially equal to the impedance of the oil tailing during the first heating stage and the impedance of the second transmission line is substantially equal to the impedance of the oil tailing during the second heating stage.

28. A system for separating oil from an oil tailing including water, the system comprising:

a chamber for receiving the oil tailing;

an RF heating system including radiating structure for applying RF energy to heat the oil tailing to a temperature sufficient to convert the water to steam and to separate the oil from the oil tailing; and a heat exchanger for recovering and recycling heat energy from at least one of the oil separated from the oil tailing, the oil tailing and the steam.

29. The system of claim 28 further comprising a blower configured to return the heat from the heat exchanger to the chamber.

30. The system of claim 29 wherein the blower provides airflow to move the heated air within the chamber.

31. The system of claim 30 wherein the airflow within the chamber maintains the temperature of the oil tailings below the temperature at which the water in the oil tailing would vaporize.

32. The system of claim 28 wherein the radiating structure is configured to have a VSWR characteristic that is selected to cause selective heating of the oil after the water has been converted to steam.

33. A system for separating oil from an oil tailing including water, the system comprising:

a chamber for receiving the oil tailing;

an RF heating system including radiating structure for applying RF energy to heat the oil tailing to a temperature sufficient to convert the water to steam and to separate the oil from the oil tailing;

a conveyor for moving the oil tailing from a first end of the chamber to the second end of the chamber; and an RF diagnostic system that measures the impedance characteristics of the oil tailing.

34. The system of claim 33 wherein the impedance characteristics measured by the RF diagnostic system is used to determine the amount of oil contained in the oil tailing.

35. The system of claim 34 further comprising a controller, the controller configured to monitor the level of power and temperature within the chamber, and in response to a measured level of power and temperature to adjust the RF energy applied to the chamber.

36. The system of claim 33 wherein the RF diagnostic system further comprises a device adapted to monitor the level of power and temperature within the chamber.

37. The system of claim 36 wherein the device includes at least one power thermistor.

38. The system of claim 36 wherein the device includes at least one fiber optic probe.

39. The system of claim 33 wherein the radiating structure is configured to have a VSWR characteristic that is selected to cause selective heating of the oil after the water has been converted to steam.

40. A system for separating oil from an oil tailing including water, the system comprising:

a chamber for receiving the oil tailing;

an RF heating system including radiating structure for applying RF energy to heat the oil tailing to a temperature sufficient to convert the water to steam and to separate the oil from the oil tailing; and a soil vapor extractor configured to extract heat from the heated oil tailing and reintroduce the heat to the chamber.

41. The system of claim 40 wherein the soil vapor extractor further comprises a heat exchanger.

42. The system of claim 41 wherein the heat exchanger provides a flow of heated air through the chamber.

43. The system of claim 41 further comprising a blower configured to reintroduce heat to the chamber.

44. The system of claim 41 configured to minimize the amount of RF energy required to remove the oil from the oil tailing.

45. The system of claim 40 wherein the radiating structure is configured to have a VSWR characteristic that is selected to cause selective heating of the oil after the water has been converted to steam.

46. A system for separating oil from an oil tailing including water, the system comprising:

A chamber including an electrically conductive wall, the chamber configured to receive the oil tailing; and An RF heating system including radiating structure for applying RF energy to heat the oil tailing to a temperature sufficient to convert the water to steam and to separate the oil from the tailing, the radiating structure having a conductive element in the form of a conveyor, the conveyor configured to move the oil tailing through the chamber.

* * * * *